United States Patent [19]

Lupia et al.

[11] 4,014,197

[45] Mar. 29, 1977

[54] BALL ROUNDING APPARATUS

[75] Inventors: Arthur W. Lupia, El Paso, Tex.; Jesus Gonzalez, Juarez, Mexico; Garrett Thurman, El Paso, Tex.

[73] Assignee: Border Steel Mills, Inc., El Paso, Tex.

[22] Filed: Feb. 19, 1976

[21] Appl. No.: 659,336

[52] U.S. Cl. ..... 72/92; 29/148.4 B; 269/254 CS

[51] Int. Cl.[2] ..... B21H 1/14

[58] Field of Search ..... 72/92, 93, 115, 117; 29/148.4 B; 248/15; 269/254 CS

[56] References Cited

UNITED STATES PATENTS

| | | | |
|---|---|---|---|
| 1,965,489 | 7/1934 | Coates | 72/92 |
| 2,208,595 | 7/1940 | Osborne | 72/92 |
| 2,929,591 | 3/1960 | Etchells et al. | 248/15 |
| 3,552,116 | 1/1971 | Siddell et al. | 248/15 X |
| 3,739,819 | 6/1973 | Swanson | 72/92 X |

FOREIGN PATENTS OR APPLICATIONS

| | | | |
|---|---|---|---|
| 1,479,413 | 3/1967 | France | 248/15 |

*Primary Examiner*—John E. Roethel
*Attorney, Agent, or Firm*—Edward E. Sachs

[57] ABSTRACT

Ball rounding apparatus includes a rotatable inner rolling die and a stationary outer die. Forged steel balls travel through an arcuate path between the dies for final rounding. The stationary outer die is made up from a plurality of segments known as die shoes. A plurality of circumferentially-spaced die shoe tension take up devices bias the die shoes toward the inner die. The die shoe tension take up devices include a one-piece plunger having an enlarged head with a flat outer surface engaging the die shoes. An integral smaller diameter shaft extends from the head of the plunger, and a small radius is formed between the shaft and head. The plunger shaft is guided for longitudinal movement through a guide sleeve, and a coil spring is positioned between the plunger head and guide sleeve for urging the head into engagement with the die shoes. The guide sleeve is adjustable for varying the distance between such sleeve and the plunger head to vary the force exerted by the coil spring. The end portion of the plunger shaft opposite from the head is externally threaded and receives an adjustment nut which bears against the guide sleeve for limiting the distance which the head may project from the guide sleeve. The dies are removably mounted between spaced-apart end plate assemblies, and the rotatable inner die is mounted on a shaft rotatable in bearings releasably secured at the bottoms of vertical slots in the end plate assemblies so that the shaft and inner die can be vertically lifted from between the end plate assemblies.

17 Claims, 4 Drawing Figures

BALL ROUNDING APPARATUS

This application pertains to the art of ball rounding apparatus and, more particularly, to certain improvements in die shoe tension take up devices used in such apparatus, and improved die mounting arrangements. Although the improvements of the present application are particularly applicable for use in rounding apparatus for final rounding of forged steel balls, it will be recognized that certain aspects of the invention may be used in other apparatus.

Steel balls are commonly forged to a generally spherical shape in a forging apparatus and are then fed down a chute for final rounding in an apparatus known in the art as a rounder. A known type of rounder includes an inner rolling die which is mounted on a rotatable drive shaft mounted in bearings between spaced-apart end plate assemblies. An outer stationary die cooperates with the inner die to form an arcuate path having a generally circular cross-sectional shape through which the balls travel when the inner die is rotated.

In previous rounders of the type described, the drive shaft for the inner die simply extends through holes in the end plate assemblies and is rotatably mounted in pillow block bearings attached to the end plate assemblies outwardly of the holes therein through which the shaft extends. In order to remove the dies from between the end plate assemblies for replacement with new undamaged dies, or dies of a different size for different sizes of balls, it was necessary to completely disassemble the bearings and end plates.

In apparatus of the type described, a plurality of circumferentially-spaced die shoe tension take up devices are mounted between the end plate assemblies and bear against the outer die for urging same toward the inner die. Previous die shoe tension take up devices were subject to breakage due to eccentric loading, and were very difficult to adjust, particularly while the rounder was operating. The die shoe tension take up devices on previous rounders were also very difficult to remove for replacement.

One known rounder of the type described is disclosed in U.S. Pat. No. 2,208,595 issued July 23, 1940, to Osborne. In the Osborne device, the die shoe tension take up devices would be extremely difficult to adjust while the rounder is operating, and replacement of such devices would require disassembly of a substantial portion of the apparatus. The Osborne adjustment includes collars threaded on shafts and retained in an adjusted position by a set screw. The set screw would always end up along a single longitudinal line because it would be difficult to reach in any other position than facing outwardly from one side of the apparatus. The Osborne springs also extend freely between the adjustment collars and die shoe engaging heads. This makes the springs subject to breakage under eccentric loads, and also allows deflection of the springs so that the force applied thereby does not always act radially of the axis of the dies.

It is therefore the primary object of the invention to provide an improved die shoe tension take up device which is easily replaceable and can be adjusted while the rounder is operating, and which has improved strength to minimize breakage.

It is a further object of the invention to provide a ball rounder with an improved mounting arrangement for the rotatable rolling die so that it is easily removable from between end plate assemblies.

An aspect of the present invention resides in a die shoe tension take up device which includes a one-piece plunger having an enlarged cylindrical head with a flat continuous outer surface, and an integral elongated substantially smaller diameter cylindrical shaft extending from the head, with a small smoothly curved radius provided between the head and shaft.

In previous arrangements where the plunger head was bolted or welded to the plunger shaft, the head tended to break from the shaft at their intersection due to stress concentrations caused by eccentric loading. It has surprisingly been found that machining the plunger from one solid piece of metal and forming a small smoothly curved radius between the head and shaft markedly improves the strength of the plunger so that breakage is substantially minimized.

In one arrangement, the flat outer surface of the plunger head is coated with a hard wear resistant material. During operation of the rounder, the outer die shifts relative to the plunger and the wear resistant coating improves the life of the plungers, and can also be renewed.

In a preferred arrangement, the plunger shaft extends through a guide sleeve, and a coil spring is positioned between the sleeve and the plunger head for biasing the plunger head into engagement with the outer die. The end portion of the plunger shaft opposite from the head is externally threaded and receives a nut which bears against the guide sleeve for limiting the distance which the head can project from the guide sleeve. The guide sleeve is mounted through a tapped hole in a mounting block so that it can be adjusted to vary the distance between the guide sleeve and plunger head, and thereby vary the force which the coil spring exerts on the outer die.

The ball rounding apparatus of the present application includes spaced-apart upright end plate assemblies having the dies mounted therebetween. The end plate assemblies have vertical slots, and releasable bearings for the drive shaft of the inner rolling die are releasably locked at the bottoms of the slots. The bearings are unlockable so that the inner die and drive shaft can be vertically lifted from between the end plate assemblies.

For a better understanding of the present invention, together with other and further objects thereof, reference is had to the following description taken in connection with the accompanying drawings, and its scope will be pointed out in the appended claims.

Figure 2:
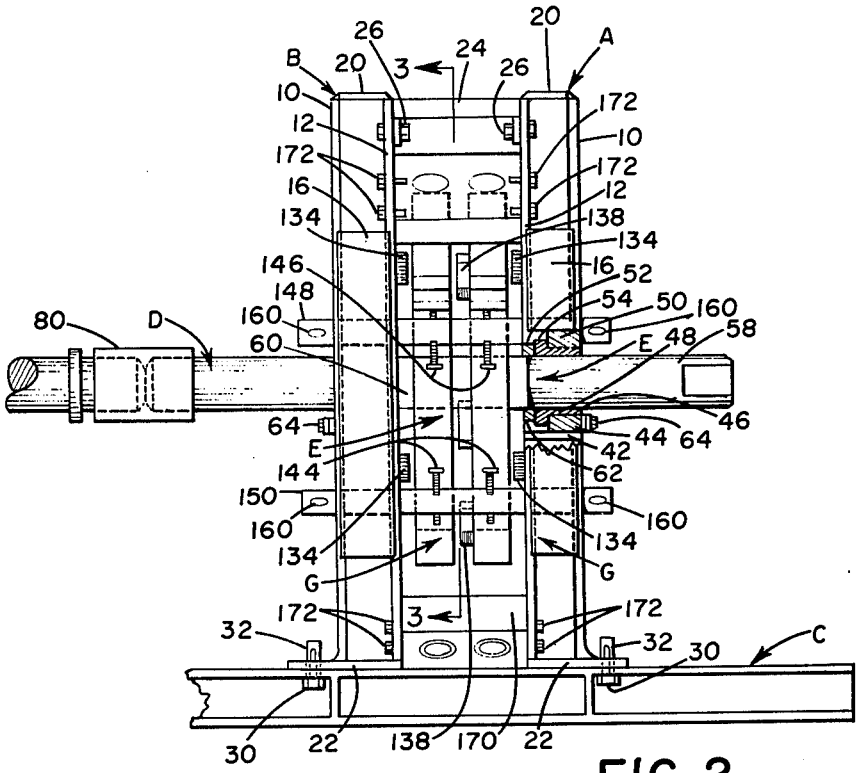
FIG. 2 is a front elevational view looking generally in the direction of arrows 2—2 of FIG. 1, and with certain portions removed and other portions cut-away for clarity of illustration.

With reference to the drawing, spaced-apart end plate assemblies A and B of FIG. 2 each include a pair of substantially parallel spaced-apart flat rectangular metal plates 10 and 12. Each pair of the plates 10 and 12 are welded together in spaced-apart relationship by front plates 16, rear plates 18, top plates 20 and bottom plates 22. Generally U-shaped spacer brackets 24 are removably secured between the plates 12 of the end plate assemblies A and B as by nut and bolt assemblies 26.

The entire end plate assemblies A and B, and the apparatus supported thereby, are mounted on a base support C of welded together channels and I-beams. The bottom plates 22 extend outwardly from the outer plates 10 and have suitable holes therethrough for receiving T-bolts 30 which also extend through suitable holes in the base support C and have vertical slots 32 therein for receiving wedges which are hammered into position in the slots 32. Hammering of the wedges in an opposite direction rapidly releases the entire assembly of the end plate assemblies A and B, and the apparatus supported thereby, for removal from base support C and replacement with a completely different ball rounding apparatus.

Figure 1:
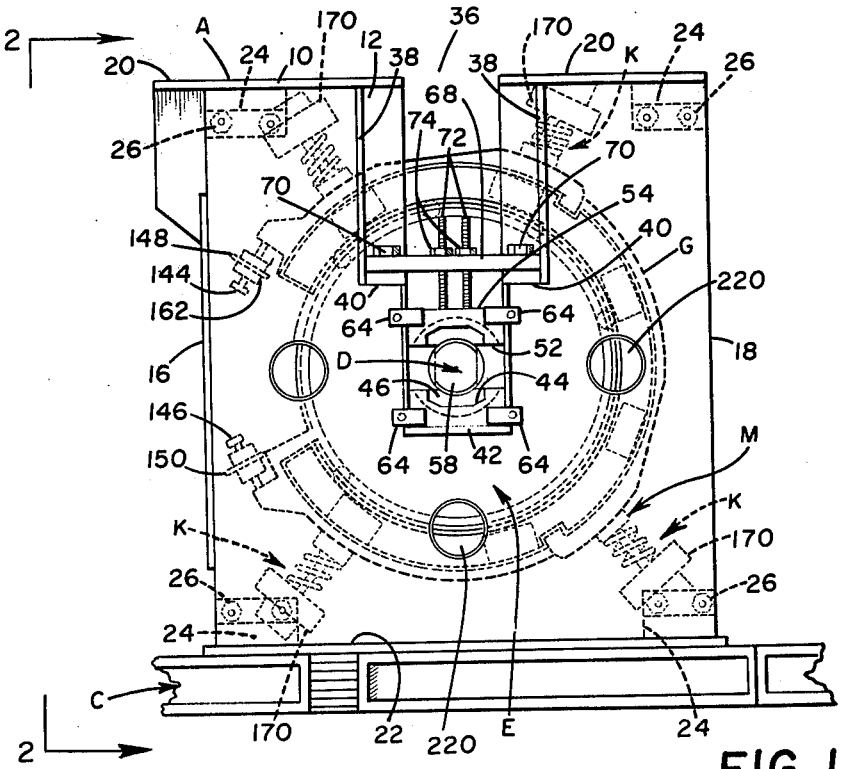
FIG. 1 is a side elevational view of a ball rounding apparatus having the improvements of the present invention incorporated therein.

Upwardly opening generally rectangular vertical slots 36 are formed in the end plate assemblies A and B as shown in FIG. 1. The upper portions of the slots 36 in the outer plates 10 are wider than the slots in the plates 12, and plates 38 are welded between the vertical edges of the wider slot portions in the plates 10 and the inner surface of the plates 12. Heavy plates 40 are welded between the bottom edges of the wider slot portions in the plates 10 and the inner surface of the plates 12. The bottom edges of the slots in the plates 10 and 12 have a flat support plate 42 welded thereacross for supporting a bearing chock 44 which supports a bottom half bearing 46 having an outwardly extending inner flange 48. An upper half bearing 50 having an outwardly extending inner flange 52 is retained in position by an upper bearing chock 54.

A horizontally extending drive shaft D has a longitudinal axis 58 and is rotatably supported in the bearing mounted in the bottoms of the slots 36. The shaft D includes a square portion 60 between the end plate assemblies A and B, and a thrust plate 62 is positioned against the shoulder between the square portion 60 and the cylindrical shaft portions supported in the bearings. Bearing chock retainer brackets 64 are suitably bolted to the outer plates 10, and urge the chocks 44 and 54 inwardly to act against flanges 48 and 52 on the bottom and top bearing halves 46 and 50 to urge them against the thrust plate 62.

A plate 68 in FIG. 1 is releasably bolted to heavy plates 40 as by bolts 70 to define part of a releasable locking means for releasably locking the bearings for shaft D at the bottoms of the slots 36. The plates 68 threadably receive adjustable bolts 72 having lock nuts 74 threaded thereon, and the bottom ends of the adjustment bolts 72 bear against a suitable wear plate positioned against upper bearing chock 54 to firmly urge and hold the entire assembly of the shaft D, the chocks 44 and 54, and the bearing halves 46 and 50 against the bottom plates 42 at the bottoms of the slots 36. The shaft D is drivingly connected with a motor drive through a gear reducer in a known manner by a separable mill coupling 80 in FIG. 2. Removal of the plates 68 and the bolts 70, and loosening of the bolts securing the brackets 64, allows vertical removal of the shaft D, and anything supported thereon, along with the upper bearing half 52 and the upper chock 54, vertically through the slots 36.

One or more pairs of inner and outer rounding dies may be mounted between the end plate assemblies A and B. In the arrangement shown in FIG. 2, there are two pairs of inner and outer rounding dies. It will be recognized that only one pair of inner dies may be so mounted, or more than two pairs of rounding dies may be so mounted. Rotatable inner rolling dies E are mounted on square portion 60 of the shaft D, while the outer stationary dies G are removably mounted between the end plate assemblies A and B outwardly of the inner dies E.

Figure 3:
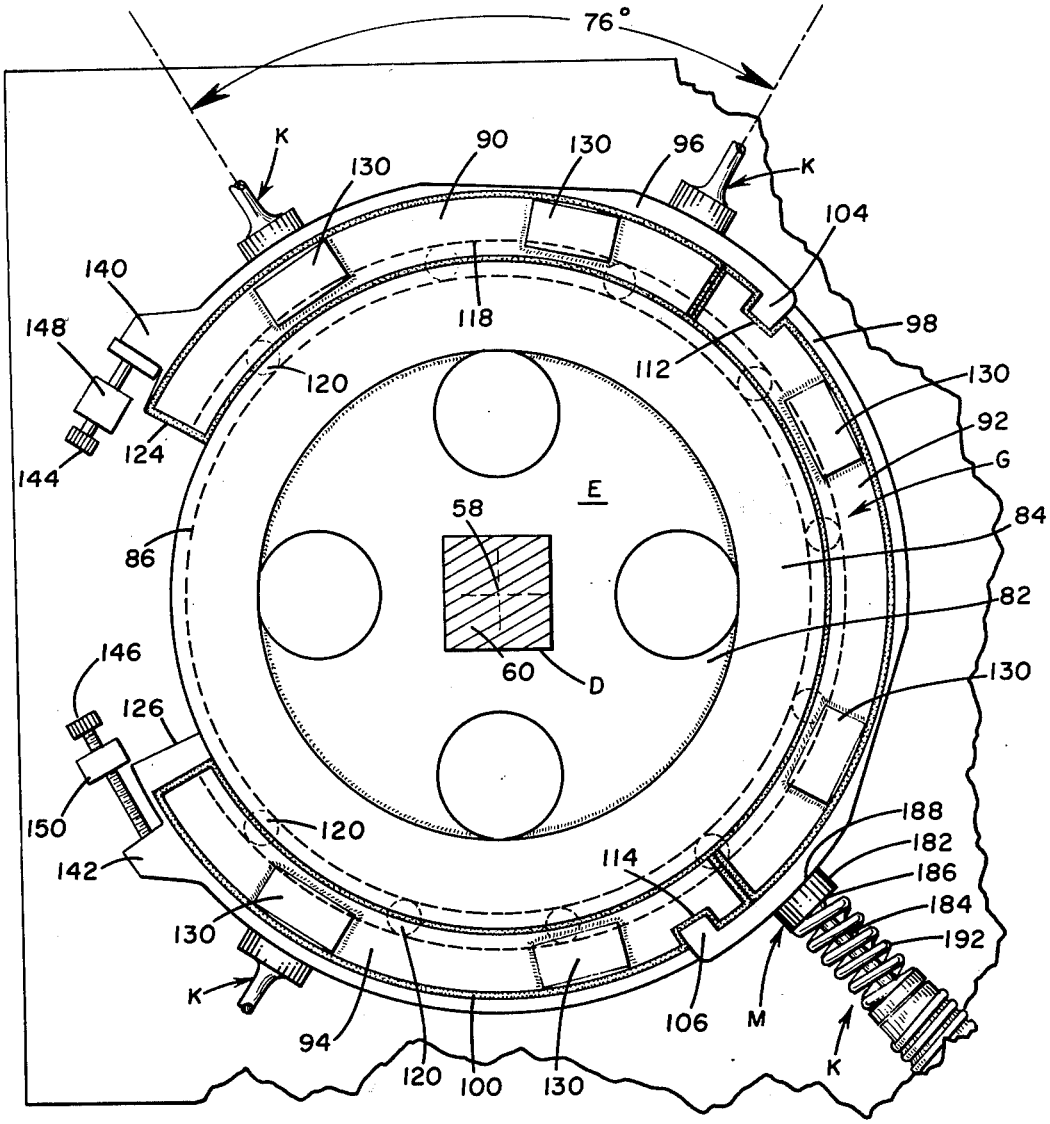
FIG. 3 is a cross-sectional elevational view taken generally on line 3—3 of FIG. 2.

As best shown in FIG. 3, inner die E includes a die wheel 82 having a die ring 84 suitably welded thereto. Generally circular or cylindrical die ring 84 has a centrally located groove 86 therein of generally semi-circular cross-sectional shape.

Outer die G is divided into a plurality of arcuate segments defined by arcuate die shoes 90, 92 and 94. Each die shoe includes an outer member 96, 98 and 100 welded thereto. Outer members 96 and 98 have downwardly extending hook end portions 104 and 106 respectively received in recesses 112 and 114 in the die shoes 92 and 94 to define an interlocking finger arrangement. The interlocking arrangement is relatively loose so that the die shoes can shift radially and axially relative to one another. All of the die shoes of outer die G have a centrally located groove 118 therein of generally semi-circular cross-sectional shape. The grooves 86 and 118 are positioned in cooperating opposed relationship to one another to define a path through which the balls 120 travel as inner die E is rotated relative to the stationary outer die G. The path through which the balls 120 travel between the dies E and G lies generally on the circumference of a circle and has a generally circular cross-sectional shape.

In the arrangement shown in FIG. 3, the outer die G is generally of a reverse C-shaped configuration, and looking at such die from the other side would show a C-shaped configuration in side elevation. Therefore, reference to a generally C-shaped outer stationary die is intended to mean an outer die having that shape from one side and a reverse C-shape from the other side.

The outer stationary die G extends over an arc greater than 180° and less than 360° to terminate at ends 124 and 126. In one arrangement, the outer die G extends over an arc of approximately 290° between the ends 124 and 126, although it will be recognized that this precise angle is not critical to the present invention. Although the inner rolling die E may rotate in either direction, one arrangement has such die rotating in a counterclockwise direction in FIG. 3 so that the forged balls 120 are introduced into the grooves 86 and 118 adjacent the end 126 of the outer die G, and such balls exit from the arcuate path between the dies E and G adjacent the end 124.

The outer die shoes 90, 92 and 94 may have spacer or wear plates 130 welded to the sides thereof for spacing adjacent dies from one another when more than one pair of inner and outer dies are assembled between the end plate assemblies A and B. Inner dies E are mounted on square portion 60 of the shaft D so they can move longitudinally relative to the shaft D within limits, and the outer dies G are similarly mounted for limited movement between the end plate assemblies A and B. As shown in FIG. 2, the end plate assemblies A and B have a plurality of inwardly extending abutments 134 which may engage the sides of the die ring 84 on the inner die E or wear plates 130 on the outer die G for limiting lateral movement of the dies longitudinally of the shaft D. Also as shown in FIG. 2, when more than one pair of the inner and outer dies E and G are used, one pair of dies may have spacers 138 welded to one side thereof for spacing the die pairs from one another.

The outer members 96 and 100 welded to the die shoes 90 and 94 have raised end abutment surfaces 140 and 142 engaged by the ends of adjustment bolts 144 and 146 threaded through suitable holes in bar members 148 and 150. Obviously, lock nuts may be provided on the bolts 144 and 146 for preventing rotation of the bolts relative to the bar members 148 and 150 once such bolts have been adjusted. The bars 148 and 150 may extend through suitable holes in the end plate assemblies A and B, and have longitudinally extending slots 160 outwardly of the end plate assemblies A and B for receiving pins 162 of FIG. 1 having holes for receiving cotter pins. The pins 162 limit lateral movement of the bars 148 and 150 relative to the end plate assemblies A and B.

The die shoe segments making up outer die G are simply positioned around the inner die E between the end plate assemblies A and B. The adjustable bolts 144 and 146 bear against the abutment surfaces 140 and 142 for preventing rotation of the outer die G so it is relatively stationary. At the same time, the outer die G and the die shoe segments thereof may shift laterally relative to inner die E. The bars 148 and 150 are easily removable from between the end plate assemblies A and B by removing the pins 162 of FIG. 1.

In order to properly tension the outer relatively stationary or non-rotating die G and the individual shoes forming same, a plurality of circumferentially-spaced die shoe tension take up devices K are mounted between the end plate assemblies A and B.

As best shown in FIGS. 1 and 2, each die shoe tension take up device K includes a mounting block 170 removably secured between the inner plates 12 of the end plate assemblies A and B of FIG. 2 by bolts 172 extending through suitable holes in the plates 12 into tapped bores in the ends of the mounting blocks 170. As shown in FIG. 2, the mounting blocks 170 have tapped holes 176 therethrough. In the arrangement shown, tapped holes 176 have their axes extending generally radially of the longitudinal axis 58 of the shaft D.

Figure 4:
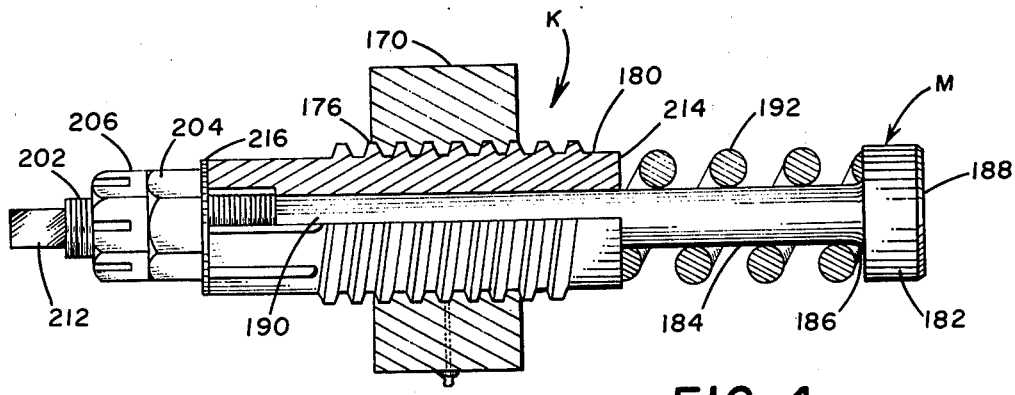
FIG. 4 is an elevational view of a die shoe tension take up device, with portions cut away and in section for clarity of illustration.

As best shown in FIG. 4, each die shoe tension take up device K includes guide means in the form of an elongated guide sleeve 180 having external acme threads for adjustably threading into the tapped hole 176 in the mounting block 170. A one-piece plunger M includes an enlarged generally cylindrical head 182 and an integral substantially smaller cylindrical shaft 184. Plunger M is formed in one integral piece from a single piece of metal bar stock or the like by machining, and the shaft 184 intersects the head 182 at a smoothly curved small radius 186. The plunger head 182 has a flat and plane continuous outer surface 188 which is coated with a wear resistant coating of hard material such as stellite which is a steel alloy containing carbon, chromium, cobalt and wolfram. Obviously, other hard and wear resistant coating materials can be applied to the flat and continuous outer surface 188 of the head 182. The wear resistant coating can be renewed as wear occurs so that it is not necessary to replace the complete plunger M. The shaft 184 is reciprocatingly guided through bore 190 in the guide sleeve 180. A coil spring 192 is positioned around the shaft 184 between the head 186 and the guide sleeve 180. The coil spring 192 biases the outer surface 188 of the head 182 into engagement with the outer peripheral surfaces of the die shoes on the outer die G.

It has been found that it is extremely important to form the plunger M of a solid piece of steel in order to minimize breakage of the head 182 from the shaft 184. It has also been found to be extremely critical to provide a small smoothly curved radius as at 186 between the plunger head 182 and the plunger shaft 184.

Elongated shaft 184 has an end portion 202 opposite from the head 182 which is externally threaded and receives an adjustment nut 204 for adjustably limiting the distance which head 182 projects from the guide sleeve 180. A lock nut 206 may also be provided for cooperation with the adjustment nut 204 and has suitable slots therein for receiving cotter pins through holes in the shaft end portion 202. The shaft 184 has a squared end portion 212 for receiving a wrench or the like to adjust both the nut 204 and the lock nut 206 for adjusting the distance which the head 182 may project from the guide sleeve 180. The guide sleeve 180 has an inner end 214 and an outer end 216, and rotation of the guide sleeve 180 relative to the mounting block 170 will vary the distance between the plunger head 182 and the guide sleeve inner end 214. This will increase or decrease the force applied against the die shoe segments of the outer die G by the plunger M under the influence of the coil spring 192. The stop nut 204 will limit the amount of force which is applied to the outer die G by the plunger M under the influence of the coil spring 192. The stop nut 204 will limit the amount of force which is applied to the outer die G by the plunger M by bearing against the outer end 216 of the guide sleeve 180.

As previously mentioned, the manufacture of the plunger in one integral piece has been found to be very important in combination with the small radius between the plunger head and the plunger shaft. In one arrangement, head 182 has a diameter of approximately 3½ inches, while shaft 184 has a diameter of approximately 1 7/8 inches. Radius 186 between the intersection of the head 182 and the shaft 184 is approximately 3/32 inch. The head 182 has a thickness of approximately 1½ inches, while the total length of the plunger M is approximately 18 ⅝ inches. In a preferred arrangement, the ratio of the diameter of the shaft 184 to the diameter of the head 182 is approximately 1 to 1.86 and does not deviate therefrom by more than approximately 10%. Therefore, when it is stated that the defined ratio is approximately 1 to 1.86, it is intended to cover ratios which vary from this by 10%.

The holes 176 in the mounting blocks 170 are of larger diameter than the heads 182 so that the guide sleeve 180, the plunger M and the coil spring 192 are removable as an assembly from the mounting blocks 170 through the holes 176 for replacement. The coil springs 192 are preferably initially compressed when the devices K are installed. In one arrangement, the springs 192 have a relaxed length of approximately 6½ inches and are compressed to 6 inches when the devices K are initially installed. Therefore, the spring force never goes to zero and this increases the spring life. The guide sleeve 180 is easily adjustable even during operation of the rounder by applying a tool to its outer end and rotating same relative to the mounting block 170 to increase or decrease the spring length between the head 182 and the guide sleeve 180, and thereby decrease or increase the spring force.

As shown in FIG. 1, there are four die shoe tension take up devices K circumferentially-spaced around each outer die G, and mounted on the mounting blocks 170 which are removably secured between the end plate assemblies A and B by the removable bolts 172 of FIG. 2. The flat outer surfaces 188 of the plunger heads 182 act against arcuate surfaces on the outer die shoe segments for minimizing eccentric loads, and insuring application of force by coil springs 192 in directions acting generally radially toward the longitudinal axis 58 of the drive shaft D so that the die shoes of the outer die G are firmly urged toward the inner rotatable die E. The die shoe tension take up devices K permit outward and lateral shifting movement of the outer die G relative to the inner die E. Outward movement of one die shoe against the yieldable biasing force of the coil spring allows introduction of crudely forged steel balls between the inner and outer dies. The balls 120 are finally rounded as they travel through the path between the dies, and this path lies generally on the circumference of a circle and has a generally circular cross-sectional shape.

It is very simple to remove the dies from between the end plate assemblies A and B by adjusting the bolts 144 and 146 to provide clearance, or removing mounting bars 148 and 150 from between the end plate assemblies A and B. The die shoe tension take up devices K above the dies can be easily removed by removing the bolts 172 in FIG. 2 from the upper mounting blocks 170. Removal of the bearings for the shaft D as previously described permits vertical lifting movement of the dies and shaft D from between the end plate assemblies A and B. Obviously, it may also be necessary to remove the spacer brackets 24 at the top of the end plate assemblies A and B.

As shown in FIG. 1, the end plate assemblies A and B have a plurality of circumferentially-spaced holes 220 therethrough in alignment with the path between the dies E and G through which the balls 120 travel. The holes 220 permit viewing of the dies during operation of the rounder for adjusting the die shoe tensioning devices K.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications which fall within the true spirit and scope of the invention.

What is claimed is:

1. Ball rounding apparatus comprising; cooperating inner and outer dies having a path therebetween of generally circular cross-sectional shape lying generally on the periphery of a circle, one of said dies being circumferentially continuous and being rotatable relative to the other of said dies about a longitudinal axis, said other die extending over an arc greater than 180° and less than 360° and being circumferentially segmented for movement toward and away from said axis, biasing means for biasing said other die toward said one die and acting generally radially of said axis, said biasing means including a plurality of circumferentially-spaced spring loaded devices, each said spring loaded device including a reciprocable one-piece plunger having an enlarged generally cylindrical head with an outer substantially flat surface engaging a peripheral surface of said other die, an elongated generally cylindrical shaft extending integrally from said head and having a diameter substantially smaller than said head, said shaft merging into said head at a small smoothly curved radius, guide means for guiding said shaft, a coil spring surrounding said shaft between said head and guide means for yieldably biasing said plunger in a direction for engaging said flat surface of said head with said other die, and adjustment means for adjusting said guide means toward and away from said other die to vary the force with which said spring biases said plunger.

2. The apparatus of claim 1 wherein said outer flat surface of said head has a coating of wear resistant material thereon.

3. The apparatus of claim 1 wherein said guide means includes an elongated guide sleeve having external threads which are threadably received in a threaded hole in a fixed support to define said adjustment means.

4. The apparatus of claim 3 wherein said guide sleeve has inner and outer ends and the end portion of said shaft opposite from said head is externally threaded for receiving nut means which bears against said outer end of said guide sleeve to adjustably limit the distance which said head extends outwardly from said inner end of said guide sleeve.

5. The apparatus of claim 1 wherein said inner and outer dies are mounted between spaced-apart end plate assemblies and said one die is mounted on a drive shaft rotatably mounted in said end plate assemblies, said end plate assemblies having upwardly opening vertical slots therein, said drive shaft being rotatably mounted in bearings at the bottoms of said slots, and releasable locking means for releasably locking said bearings to said end plate assemblies so that said locking means may be released for vertically lifting said shaft and dies from between said end plate assemblies.

6. The apparatus of claim 5 wherein each said end plate assembly comprises a pair of spaced-apart plates, and support means spanning said plates of each pair at the bottoms of said slots for supporting said bearings.

7. The apparatus of claim 1 wherein said one die comprises said inner die and said other die comprises said outer die.

8. A die shoe tension take up device for a ball rounder or the like comprising; a one-piece plunger having an enlarged generally cylindrical head including a substantially flat outer surface, an elongated generally cylindrical shaft extending integrally from said head, said shaft intersecting said head at a small smoothly curved radius, guide means for guiding said shaft in longitudinal movement, and a coil spring received around said shaft between said head and guide means for biasing said head away from said guide means.

9. The device of claim 8 wherein the end portion of said shaft opposite from said head is externally threaded, and nut means received on said end portion for bearing against said guide means to adjustably limit the distance which said head projects from said guide means.

10. The device of claim 8 wherein said guide means comprises an externally threaded guide sleeve receivable in a threaded opening in a support for adjusting the distance between said sleeve and head and thereby vary the force with which said spring biases said head away from said sleeve.

11. The device of claim 8 including a coating of hard wear resistant material on said flat outer surface of said head.

12. The device of claim 8 wherein the ratio of the diameter of said shaft to the diameter of said head is approximately 1 to 1.86.

13. The device of claim 8 including inner and outer dies removably mounted between upright end plate assemblies, said inner die being circumferentially continuous and said outer die being generally C-shaped, said dies having an arcuate ball rolling path therebetween of generally circular cross-sectional shape, said inner die being mounted on a drive shaft rotatably and removably mounted to said end plate assemblies, and a plurality of said tension take up devices removably mounted between said end plate assemblies in circumferentially-spaced relationship and having said flat outer surfaces of said heads engaging the outer periphery of said outer die.

14. The device of claim 13 wherein said tension take up devices are mounted on mounting blocks removably bolted between said end plate assemblies, said blocks having tapped holes therethrough, said guide means comprising an elongated externally threaded guide sleeve received in said tapped hole in each said block for adjustable threading movement toward and away from said outer die to vary the distance between said guide sleeves and heads and thereby varying the force with which said coil springs bias said heads into engagement with said outer die.

15. The device of claim 14 wherein the end portions of said shafts opposite from said heads are externally threaded and receive nuts which bear against said guide sleeves to adjustably limit the distance which said heads can project from said guide sleeves and thereby limit the force exerted on said outer die by said coil springs acting on said plungers.

16. The device of claim 15 wherein said end plate assemblies have vertical slots therein and said drive shaft is rotatably mounted in bearings releasably secured to said end plate assemblies at the bottoms of said slots, whereby said bearings may be released to vertically lift said drive shaft and inner die from between said end plate assemblies.

17. The device of claim 14 wherein said tapped holes in said mounting blocks have a diameter greater than the diameter of said heads, whereby said guide sleeve, plunger and coil spring are removable as a unitary assembly from said mounting blocks for replacement.

* * * * *